US005532424A

United States Patent [19]

Hideo

[11] Patent Number: 5,532,424

[45] Date of Patent: Jul. 2, 1996

[54] TONE GENERATING APPARATUS INCORPORATING TONE CONTROL UTLIIZING COMPRESSION AND EXPANSION

[75] Inventor: Suzuki Hideo, Hamamatsu, Japan

[73] Assignee: Yamaha Corporation, Japan

[21] Appl. No.: 247,869

[22] Filed: May 23, 1994

[30] Foreign Application Priority Data

May 25, 1993 [JP] Japan ..... 5-145530
Apr. 27, 1994 [JP] Japan ..... 6-112218

[51] Int. Cl.[6] ..... G10H 1/12; G10H 7/12

[52] U.S. Cl. ..... 84/607; 84/622; 84/DIG. 9; 84/DIG. 10

[58] Field of Search ..... 84/603–607, 622–625, 84/661, DIG. 9, DIG. 10

[56] References Cited

U.S. PATENT DOCUMENTS 4,781,096 11/1988 Suzuki et al. .
4,907,484 3/1990 Suzuki et al. ..... 84/661
4,991,484 2/1991 Kawashima ..... 84/603
5,136,917 8/1992 Kunimoto ..... 84/661 X
5,248,845 9/1993 Massie et al. ..... 84/661 X
5,250,748 10/1993 Suzuki ..... 84/661
5,266,734 11/1993 Komano et al. ..... 84/607
5,308,918 5/1994 Yamauchi et al. ..... 84/661 X
5,359,146 10/1994 Funaki et al. ..... 84/661 X

*Primary Examiner*—Stanley J. Witkowski
*Attorney, Agent, or Firm*—Graham & James

[57] ABSTRACT

A tone generator for an electronic musical instrument analyzes an original waveform signal to store results of analysis thereof into a memory. The results of the analysis read out from the memory is interpolated to generate results of the interpolation in synchronism with each sampling clock. The results of the analysis are corrected to cancel a frequency characteristic to be imparted to the results of the analysis when they are interpolated. The results of the analysis are stored into the memory after having been converted. In another form, a reading numerical value formed of an integer part and a decimal part is generated, in synchronism with a predetermined clock timing. The numerical value is variable at a rate proportional to the pitch of a musical tone to be produced. Residual waveform samples read from the memory based on the integer part are interpolated by the use of the decimal part in synchronism with a predetermined clock timing. Synthesized samples are generated based on the interpolated samples and predicted samples generated from the synthesized samples previously generated, for reproducing musical tones.

10 Claims, 6 Drawing Sheets

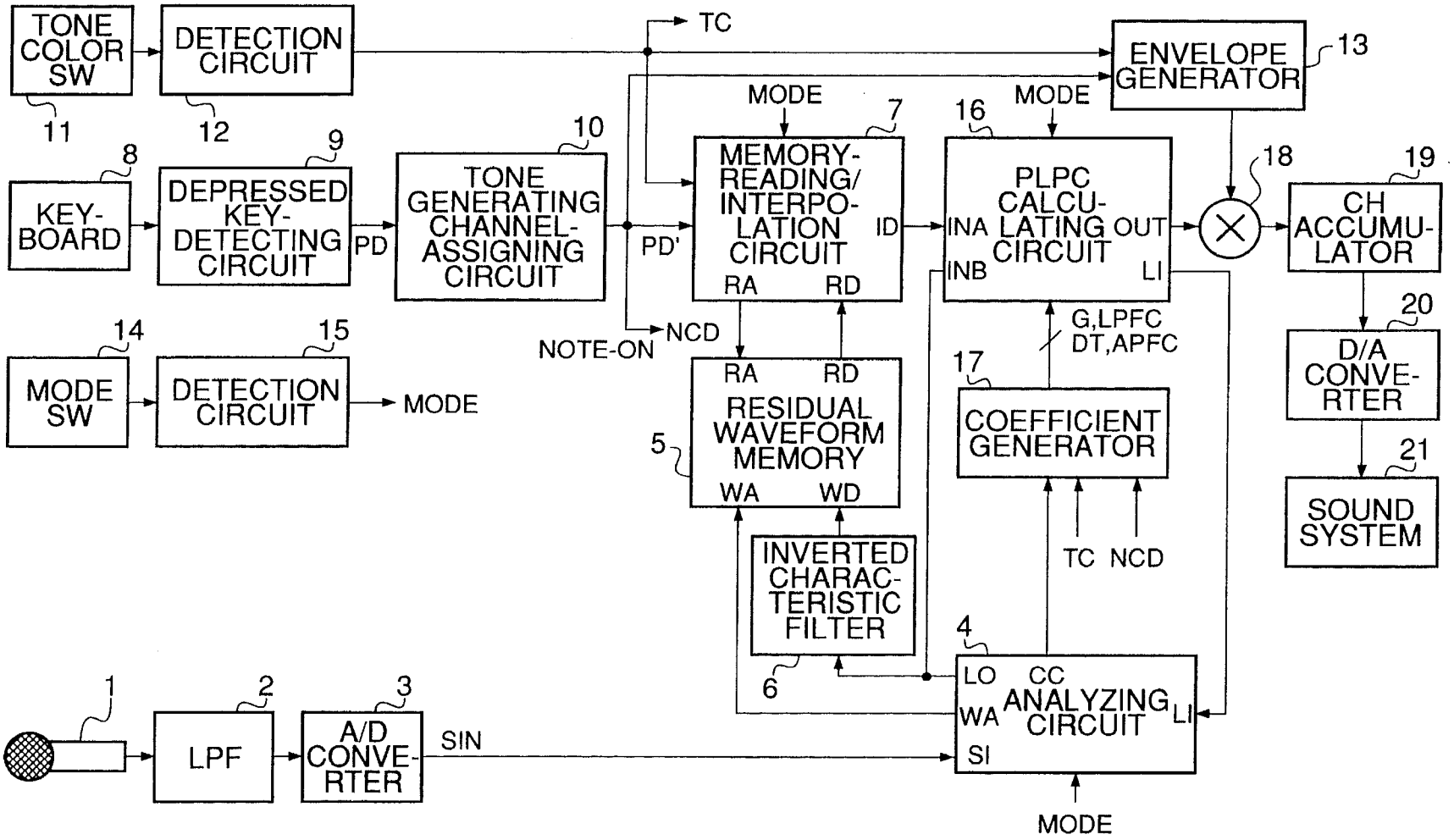
FIG.1
TONE COLOR SW
11
KEY-BOARD
8
MODE SW
14
DETECTION CIRCUIT
12
DEPRESSED KEY-DETECTING CIRCUIT
9
DETECTION CIRCUIT
15
TONE GENERATING CHANNEL-ASSIGNING CIRCUIT
10
MEMORY-READING/INTERPO-LATION CIRCUIT
7
RA
RD
ID
RESIDUAL WAVEFORM MEMORY
5
WA
WD
INVERTED CHARAC-TERISTIC FILTER
6
PLPC CALCU-LATING CIRCUIT
16
INA
INB
OUT
LI
COEFFICIENT GENERATOR
17
CC ANALYZING CIRCUIT
4
LO
WA
SI
LI
ENVELOPE GENERATOR
13
18
CH ACCUMU-LATOR
19
D/A CONVE-RTER
20
SOUND SYSTEM
21
LPF
2
A/D CONVE-RTER
3
1
TC
MODE
PD
PD'
NCD
NOTE-ON
G,LPFC
DT,APFC
TC
NCD
SIN

TONE GENERATING APPARATUS INCORPORATING TONE CONTROL UTLIIZING COMPRESSION AND EXPANSION

FIELD OF THE INVENTION

This invention relates to a tone generator for electronic musical instruments, which is adapted to perform recording by compressing an input signal and storing the compressed signal, and perform reproduction of musical tones by expanding the compressed signal to synthesize a musical tone signal to be reproduced.

PRIOR ART

A conventional tone generator for an electronic musical instrument has been proposed which performs recording by sampling an input tone signal at a predetermined sampling frequency into sampled data, and then compressing the sampled data by a predetermined data compression method to store the compressed data into a memory. Such a tone generator performs reproduction of musical tones by reading the compressed data from the memory as desired and then expanding the read data into a tone signal to thereby generate a musical tone. However, conventionally, the data processing technique of "compression" and "expansion" has never been utilized in controlling the tone color of a musical tone generated.

Further, it has not been considered to input to an expansion circuit which expands the compressed data, residual waveform samples which are formed by interpolation of successive compressed waveform samples obtained by the sampling, with input timing asynchronous with the pitch, i.e. fixed timing based on clocks.

In general, the waveform-compressing technique cannot accurately reproduce an original waveform unless all the compressed waveform samples are supplied to the expansion circuit. Therefore, it has been commonly employed to sequentially read the residual waveform samples one by one, to subject the read residual waveform samples to calculation with respect to previously expanded waveform samples to sequentially expand each of the read residual waveform samples. The pitch-asynchronous system requires interpolation of time-series samples for prevention of aliasing noise, if the compressed waveform data are to be reproduced at any desired pitch. According to the conventional method, however, compressed waveform samples are read one by one and supplied to the expansion circuit, and then interpolation is carried out on the resulting expanded samples.

The present invention contemplates using the circuitry for "compression" and "expansion" to control the tone color or quality of musical tones to be reproduced, without relying upon the conventional waveform compression and expansion method. To this end, it is required to design the construction of the compression circuit and that of the expansion circuit so as to be different from each other, and set coefficients used in these circuits to different values between the circuits such that a waveform delivered from the expansion circuit differs from one input to the compression circuit, though the two circuits and respective coefficients are conventionally required to be identical. The present assignee has already proposed, by Japanese Patent Application No. 4-312944, to control the pitch of musical tones to be reproduced according to a key code input via a performance operating element, by controlling a reading rate at which data are read from the waveform memory and the loop delay length of a synthesizing filter for synthesizing a musical tone signal to be reproduced. However, according to this proposal, the reading operation and the construction of the synthesizing filter are not fully deliberated to achieve the control of the tone color. Therefore, when the above-mentioned conventional waveform compression and expansion technique is applied, it is required that compressed waveform samples before interpolation are sequentially supplied to the synthesizing filter (expansion circuit) one by one.

On the other hand, when the conventional interpolation technique according to the pitch-asynchronous method is applied to the compression of waveform data, there arises the following problems:

Conventional tone generators equipped with pitch-asynchronous type waveform memories include interpolating means for reproducing musical tones in a pitch-asynchronous manner.

As shown in FIG. 7*a* to FIG. 7*c*, the frequency characteristics of the interpolation means generally depend on the pitch. In examples shown in FIG. 7*a* to FIG. 7*c*, the interpolation means is constructed such that signal components above a predetermined frequency are cut off. FIG. 7*a* shows a frequency characteristic of the interpolation means exhibited when the pitch of a musical tone to be reproduced is not changed, i.e. identical to that of a musical tone sampled in recording. FIG. 7*b* shows a frequency characteristic of same exhibited when the pitch of a musical tone to be reproduced is lowered by P4th (perfect 4th), and FIG. 7*c* shows the frequency characteristic of same exhibited when the pitch of a musical tone to be reproduced is lowered by one octave. To expand a compressed waveform into a waveform before compression with high fidelity, and output same, the compressed waveform supplied to the expansion circuit must have the same frequency characteristic as one it had immediately before compression.

SUMMARY OF THE INVENTION

It is an object of the invention to provide a tone generator for electronic musical instruments, which is simple in construction but capable of performing tone control by utilizing the technique of "compression" and "expansion" and synthesizing musical tones having any desired pitch.

It is another object of the invention to provide a tone generator for electronic musical instruments, which is capable of canceling undesirable frequency characteristics imparted to a tone signal during interpolation of compressed waveform data, to thereby achieve tone control as desired, and is also capable of interpolating waveform data before expansion.

To attain the above objects, according to a first aspect of the invention, there is provided a tone generator for an electronic musical instrument, comprising:

loop means for circulating an input signal therein to generate a waveform signal having a predetermined characteristic, the loop means having delay means and filter means;

analyzing means for receiving an original waveform signal and for analyzing the original waveform signal to output results of the analysis;

memory means for storing the results of the analysis by the analyzing means;

readout means for reading out the results of the analysis from the memory means;

interpolating means for interpolating the results of the analysis read out from the memory means to generate results of the interpolation in synchronism with each sampling clock to supply same to the loop means as the input signal; and correcting means for correcting the results of the analysis by the analysis means so as to cancel a frequency characteristic to be imparted to the results of the analysis when the results of the analysis are interpolated by the interpolating means;

the results of the analysis being stored into the memory means after having been corrected by the correcting means.

Preferably, the tone generator includes pitch-designating means for designating a pitch of a musical tone to be reproduced, and the readout means includes reading numerical value-generating means for generating a reading numerical value which is variable at a rate proportional to the pitch of the musical tone designated by the pitch-designating means, in synchronism with predetermined clock timing, the readout means being for reading the results of the analysis from the memory means, based on the reading numerical value.

Preferably, the correcting means raises a level of higher frequency components of a waveform signal representative of the results of the analysis.

According to a second aspect of the invention, there is provided a tone generator for an electronic musical instrument, comprising:

residual waveform memory for storing residual waveform samples;

pitch-designating means for designating a pitch of a musical tone to be generated;

reading numerical value-generating means for generating a reading numerical value formed of an integer part and a decimal part in synchronism with a predetermined clock timing, the reading numerical value being variable at a rate proportional to the pitch of the musical tone designated by the pitch-designating means;

reading means for reading the residual waveform samples from the residual waveform memory, based on the integer part of the reading numerical value;

interpolating means for generating interpolated samples, based on the residual waveform samples read out from the residual waveform memory, by the use of the decimal part of the reading numerical value, in synchronism with the predetermined clock timing; and synthesizing filter means for generating synthesized samples based on the interpolated samples, the synthesizing filter means including predicting means having a delaying element which has a delay amount corresponding to the pitch, the predicting means being for generating predicted samples from the synthesized samples previously generated by the synthesizing filter means, and synthesizing means for generating the synthesized samples, based on the interpolated samples generated by the interpolating means and the predicted samples generated by the predicting means.

According to a third aspect of the invention, there is provided a tone generator for an electronic musical instrument, comprising:

waveform input means for inputting an original waveform signal;

analyzing filter means for analyzing the original waveform signal input by the waveform input means and for generating a waveform signal representative of results of the analysis;

converting means for converting the waveform signal representative of the results of the analysis by changing a sampling interval for reading the waveform signal representative of the results of the analysis, to deliver a converted waveform signal; and synthesizing filter means for synthesizing a musical tone signal indicative of a musical tone, based on the converted waveform signal.

Preferably, the converting means imparts a predetermined frequency characteristic to the waveform signal representative of the results of the analysis, when the sampling interval is changed, and the tone generator including correcting means interposed between the analyzing filter means and the converting means, for correcting the waveform signal representative of the results of the analysis such that the predetermined frequency characteristic is canceled.

Preferably, the tone generator includes memory means for storing data of the waveform signal representative of the results of the analysis, and the converting means includes:

pitch-designating means for designating a pitch of the musical tone;

reading numerical value-generating means for generating a reading numerical value formed of an integer part and a decimal part, in synchronism with a predetermined clock timing, the reading numerical value being variable at a rate proportional to the pitch of the musical tone designated by the pitch-designating means;

reading means for reading the data of the waveform representative of the results of the analysis from the memory means, based on the integer part of the reading numerical value; and interpolating means for generating interpolated samples, based on the data of the waveform signal representative of the results of the analysis read from the memory means, by the use of the decimal part of the reading numerical value, in synchronism with the predetermined timing clock.

According to a fourth aspect of the invention, there is provided a tone generator for an electronic musical instrument, comprising:

a waveform memory;

waveform input means for inputting an original waveform signal;

analyzing filter means for analyzing the original waveform signal input by the waveform input means, and for generating a waveform signal representative of results of the analysis;

correcting means for correcting the waveform signal representative of the results of the analysis by raising a level of higher frequency components thereof, and for delivering the corrected waveform signal; and writing means for writing the corrected waveform signal into the waveform memory.

The above and other objects, features, and advantages of the invention will become more apparent from the following detailed description taken in conjunction with the accompanying drawings.

BRIEF DESCRIPTION OF THE DRAWINGS

FIG. 1 is a block diagram showing the whole arrangement of a tone generator for an electronic musical instrument, according to an embodiment of the invention;

DETAILED DESCRIPTION

The invention will now be described in detail with reference to drawings showing an embodiment thereof.

First, the outline of a tone generator for an electronic musical instrument according to the embodiment will be described with reference to FIG. 1 schematically showing the whole arrangement thereof. An analog signal indicative of a musical tone (having an original waveform) input via a microphone 1 has its high frequency components cut of or removed by a low-pass filter (hereinafter referred to as "the LPF") 2 and converted into a digital signal by an analog-to-digital converter (hereinafter referred to as "the A/D converter") 3, which is then supplied as a signal SIN (Sound Input) to an analyzing circuit 4 through an input terminal SI thereof.

Figure 2:
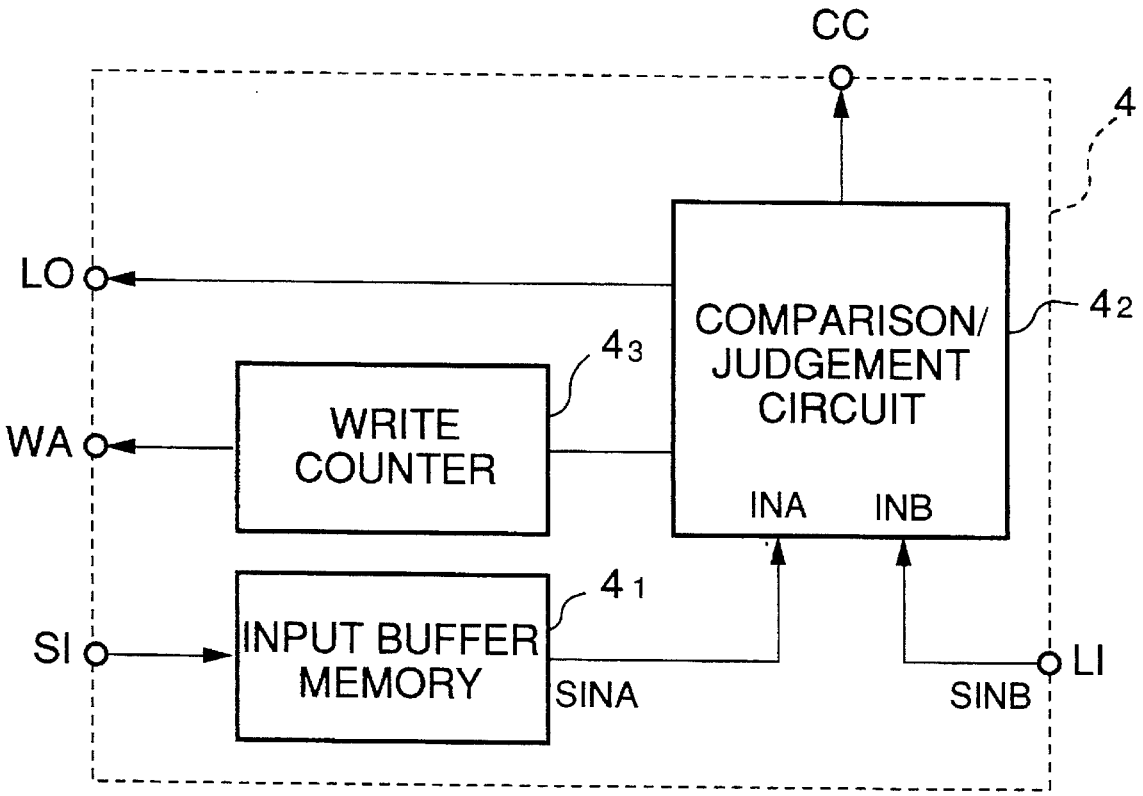
FIG. 2 is a block diagram showing details of the construction of an analyzing circuit appearing in FIG. 1.

FIG. 2 shows details of the construction of the analyzing circuit 4. The input terminal SI thereof is connected via an input buffer memory $4_1$ to one input terminal INA of a comparison/judgment circuit $4_2$ which has the other input terminal INB thereof connected to an input terminal LI for receiving a signal from a PLPC calculating circuit 16, described hereinafter. The comparison/judgment circuit $4_2$ determines a difference (SINA–SINB) of two signals (hereinafter referred to as "the signal SINA" and "the signal SINB", respectively) input to its input terminals INA and INB, and delivers same through an output terminal LO, while it delivers a control signal to a write counter $4_3$ for control of same. The write counter $4_3$ is provided for determining write addresses of a residual waveform memory 5, referred to hereinafter, based on the control signal input thereto from the comparison/judgment circuit $4_2$, and delivers same through an output terminal WA of the analyzing circuit 4. Further, the comparison/judgment circuit $4_2$ delivers control information for control of a coefficient generator 17, referred to hereinafter, through an output terminal CC, depending on results of comparison.

Referring again to FIG. 1, the analyzing circuit 4 has its output terminal WA connected to a write address input terminal WA of the residual waveform memory 5, and its output terminal LO to a write data input terminal WD of same via an inverted characteristic filter 6, whereby the above-mentioned signal indicative of the difference or residual (SINA–SINB) (hereinafter referred to as "the signal (SINA–SINB)") is filtered by the inverted characteristic filter 6 to be written into an address of the residual waveform memory 5 designated by an output from the write counter $4_3$.

Figure 3:
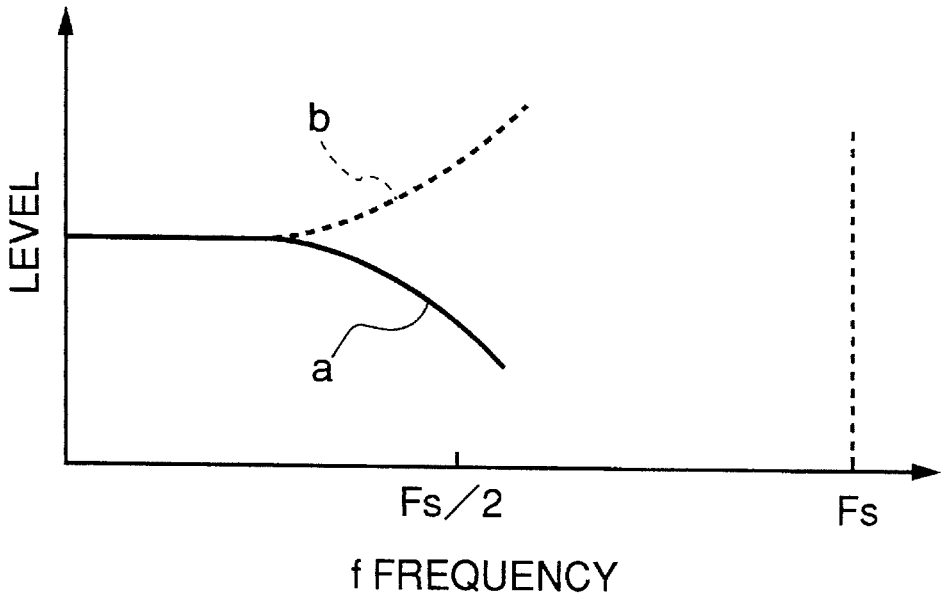
FIG. 3 is a diagram showing frequency characteristic curves of an interpolating filter and an inverted characteristic filter according to the embodiment.

Thus, the signal (SINA–SINB) from the analyzing circuit 4 is filtered by the inverted characteristic filter 6 which has a frequency characteristic b shown in FIG. 3, and then stored into the residual waveform memory 5.

More specifically, when the interpolation is effected by interpolation filter means (implemented by memory-reading/interpolation circuit 7, referred to hereinafter) of the present embodiment, the frequency characteristic a (indicated by the solid line in FIG. 3), i.e. the signal level of the interpolation filter means starts to lower at a predetermined frequency, which is lower than a predetermined frequency Fs/2, and descends rightward, i.e. as the frequency f increases, which can result in an error in the reproduced waveform. According to the present embodiment, to prevent such an error, before an input tone signal is stored into the residual memory 5, the waveform of the input tone signal is filtered by the inverted characteristic filter 6 with the frequency characteristic b (indicated by the broken line in FIG. 3) which is inverse to the characteristic a of the interpolation filter means, and the filtered signal is stored into the residual waveform memory 5.

Figure 4:
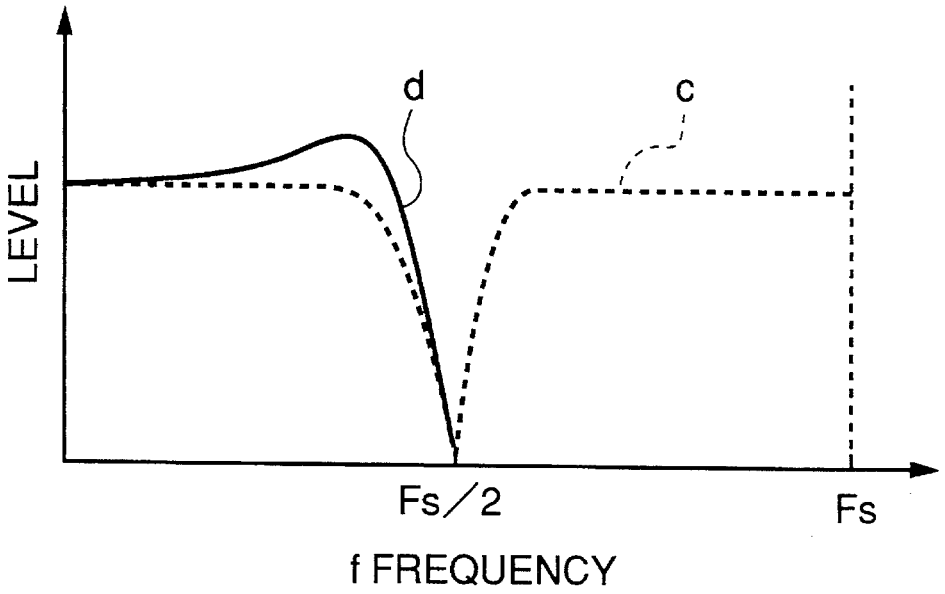
FIG. 4 is a diagram showing a frequency characteristic of an input musical tone signal sampled for recording, and a frequency characteristic of an input musical tone signal filtered by the inverted characteristic filter.

FIG. 4 shows characteristic curves indicative of a frequency characteristic of an input tone signal sampled, and a frequency characteristic of the same input tone signal having been filtered by the inverted characteristic filter 6, wherein the abscissa represents the frequency f, and the ordinate the level of the signal. In the figure, the broken line curve c designates the frequency characteristic of the input tone signal sampled, and the solid line curve d the frequency characteristic of the input tone signal filtered by the inverted characteristic filter 6. More specifically before the input tone signal is stored into the residual waveform memory 5, the level of signal components in a predetermined frequency range (higher frequency components in the present embodiment) is raised, and the level of the signal is lowered when interpolation for reproduction of the musical tone is effected, so that the resulting reproduced tone signal has a generally flat frequency characteristic.

Referring again to FIG. 1, a readout address input terminal RA and a readout data output terminal RD of the residual waveform memory 5 are connected to a readout address output terminal RA and a readout data output terminal RD of the memory-reading/interpolation circuit 7, respectively. The memory-reading/interpolation circuit 7 addresses the residual waveform memory 5 via the readout address output terminal RA and reads out waveform data from the memory 5 via the readout data input terminal RD.

A keyboard 8 is connected to the memory-reading/interpolation circuit 7 via a depressed key-detecting circuit 9 and a tone generating channel-assigning circuit 10. The depressed key-detecting circuit 9 detects depression of keys of the keyboard 8 and delivers performance data PD (note code NCD, note-on/note-off, etc.) indicative of the detected depression of keys to the tone generating channel-assigning circuit 10, where each item of the performance data PD is assigned to a time slot for time-sharing processing. As is generally known, the tone generator is constructed such that the circuits thereof are operated in a time-sharing manner so as to cause a plurality of musical tones to be generated from one circuit. The tone generating channel-assigning circuit 10 determines a time slot to which each item of the performance data PD is to be assigned. For the sake of simplicity, the following description is based upon the assumption that an item PD' has been allotted to one time slot and the item PD' is delivered from the tone generating channel-assigning circuit 10.

Further, the electronic musical instrument includes a tone color switch 11 for selectively designating a tone color from various tone colors. Information on a tone color selected by the tone color switch 11 is detected by a detection circuit 12, and a tone color signal TC indicative of the detected tone color is supplied to an envelope generator 13 for generating an envelope of the tone signal to be reproduced, as well as to the memory-reading/interpolation circuit 7.

Further, according to the present embodiment, the electronic musical instrument includes a mode changeover switch 14 for changing over the operation of the electronic musical instrument between a recording mode in which a signal indicative of a musical tone detected by the microphone 1 is processed for storing data indicative of the waveform of the musical tone into the residual waveform memory 5, and a reproducing mode in which data of the musical tone waveform stored in the residual waveform memory 5 is read out for reproducing a musical tone. The operative state of the changeover switch 14 is detected by a detection circuit 15 in the form of a logical state of a signal MODE, which is set to "1" when the reproducing mode has been selected by the changeover switch 14, and to "0" when the recording mode has been selected by same. The signal MODE is delivered to the memory-reading/interpolation circuit 7, as well as to the PLPC calculating circuit 16, referred to hereinafter. Thus, the tone generator of the present embodiment can perform both the processings of recording of an input tone signal and reproducing of the recorded tone signal.

Figure 5:
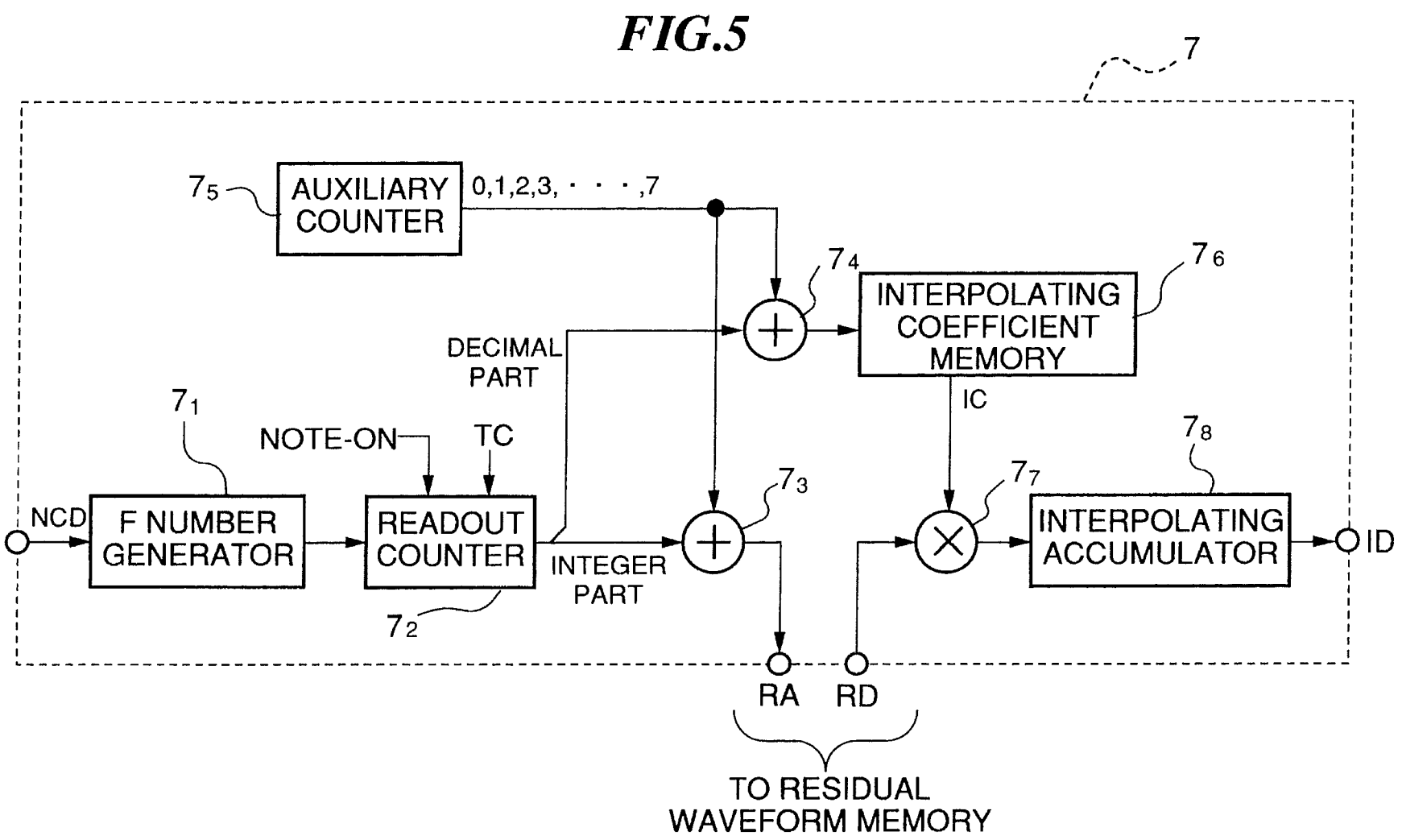
FIG. 5 is a block diagram showing details of the construction of a memory readout/interpolation circuit appearing in FIG. 1.

FIG. 5 shows details of the construction of the memory-reading/interpolation circuit 7 appearing in FIG. 1, which is comprised of an F number generator $7_1$ which is responsive to the note code NCD (indicative of the pitch of the input tone) of the performance data PD' from the tone generating channel-assigning circuit 10, for generating and delivering a value of an F number proportional to the frequency indicated by the note code NCD to a readout counter $7_2$. The readout counter $7_2$ is also supplied with the tone color signal TC and the note-on data, and starts to output its count value, which increases at a rate corresponding to the F number value, from the starting address of the residual waveform memory 5 corresponding to the tone color signal TC, upon inputting of the note-on data. That is, the count value delivered from the readout counter $7_2$ represents a storage location of the residual waveform memory 5 corresponding to the tone color signal TC and increases at a rate proportional to the frequency of the note code NCD.

In the case where a fixed (i.e. pitch-asynchronous) output sampling frequency is used, the output from the readout counter $7_2$ generally assumes a positive real number, which is separated into an integer part and a decimal part to be delivered to input terminals of respective adders $7_3$ and $7_4$. The adders $7_3$, $7_4$ have the other input terminals thereof both connected to an output terminal of an auxiliary counter $7_5$ which sequentially generates an integer from 0 to 7 for each period corresponding to the selected tone-generating channel. The adder $7_3$ has an output terminal thereof connected to the readout address input terminal RA of the residual waveform memory 5, and sequentially adds eight output values (0 to 7) from the auxiliary counter $7_5$ to the count value from the readout counter $7_2$ to sequentially deliver the resulting sum values to the residual waveform memory 5 via the readout address input terminal RA thereof.

Further, an output from the adder $7_4$ is supplied to an interpolating coefficient memory $7_6$, which in turn delivers its output to a multiplier $7_7$ via one input terminal thereof. The multiplier $7_7$ has the other input terminal thereof supplied with an output from the readout data output terminal RD of the residual waveform memory 5, and delivers its output to an interpolating accumulator $7_8$ which in turn delivers its output via an output terminal ID to the PLPC calculating circuit 16.

That is, the adder $7_3$ sequentially adds the integers 0 to 7 from the auxiliary counter $7_5$ to the output value of the integer part from the readout counter $7_2$ for each of the tone-generating channels, thereby generating seven successive integer values, i.e. the current integer part of the count value of the readout counter $7_2$ and seven successive integer values subsequent thereto, to sequentially deliver eight integer values in total as addresses from the memory-reading/interpolation circuit 7 to the readout address input terminal RA of the residual waveform memory 5. The residual waveform memory 5 sequentially delivers, via its readout data output terminal RD, waveform data stored in the memory 5 addressed by the eight integer values generated by the adder $7_3$. On the other hand, the adder $7_4$ sequentially adds the integers 0 to 7 to the output value of the decimal part from the readout counter $7_2$ (i.e. synthesize each of the integer values and the output value of the decimal part from the readout counter $7_2$), thereby generating eight sum values, i.e. the current decimal part of the count value of the readout counter $7_2$ and seven values obtained by sequentially adding a value of 1 to the current decimal part seven times, and sequentially applies the resulting eight sum values to the interpolating coefficient memory $7_6$. The interpolating coefficient memory $7_6$ generates eight interpolating coefficients corresponding respectively to the eight output values from the adder $7_4$. The multiplier $7_7$ multiplies the eight interpolating coefficients output from the interpolating coefficient memory $7_6$ by respective ones of eight items of the waveform data read out from the residual waveform memory 5 in the order read out. The interpolating accumulator $7_8$ sequentially accumulates eight products supplied from the multiplier $7_7$, and delivers the results of accumulation as interpolated waveform data via the output terminal ID to the PLPC calculating circuit 16.

The interpolating coefficient memory $7_6$ stores FIR filter coefficients, which have been obtained by subjecting a frequency characteristic with frequency components equal to and higher than ½ of the sampling frequency Fs used in recording cut off, to inverse Fourier transform. In general, Lagrange's coefficients are often used as the interpolating coefficients. In the present embodiment, however, FIR filter coefficients are employed. This is because if Lagrange's coefficients are used for interpolation, the frequency characteristic can vary during interpolation to cause generation of interpolation noises.

Referring again to FIG. 1, the interpolated waveform data output from the output terminal ID of the memory-reading/interpolation circuit 7 is applied to an input terminal INA of the PLPC calculating circuit 16, which has its input terminal INB supplied with an output from the output terminal LO of the analyzing circuit 4. Further, the PLPC calculating circuit 16 is supplied with an output from a coefficient generator 17. The coefficient generator 17 generates coefficient LPFC, DT, APFC, and G, referred to hereinafter, according to the tone color TC, the note code NCD and an output from the output terminal CC of the analyzing circuit 4.

Figure 6:
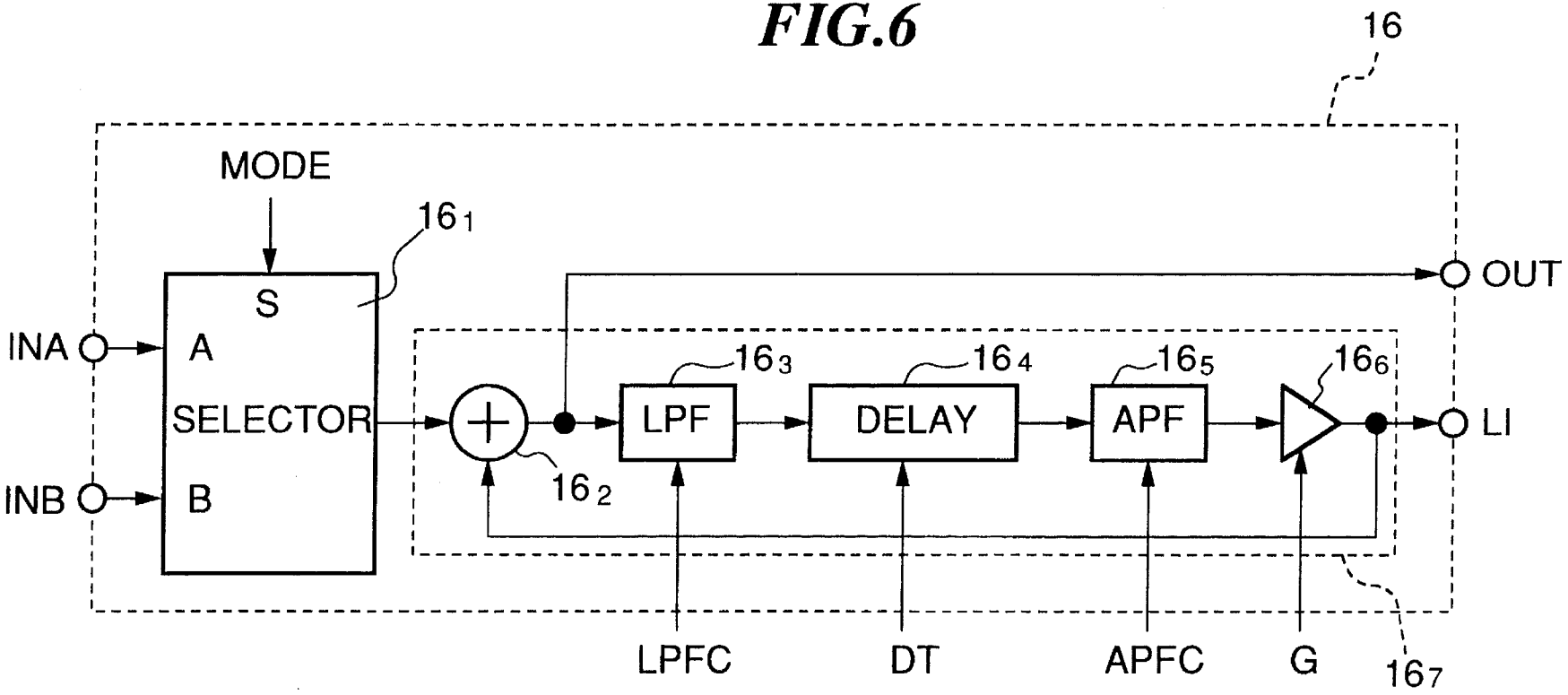
FIG. 6 is a block diagram showing details of the construction of a PLPC calculating circuit appearing in FIG. 1.

FIG. 6 shows details of the PLPC calculating circuit 16 appearing in FIG. 1.

The PLPC calculating circuit 16 is supplied with waveform data, as an input INB, from the output terminal LO of the analyzing circuit 4, and waveform data, as an input data INA, from the memory-reading/interpolation circuit 7. The inputs INA and INB are applied to input terminals A and B of a selector $\mathbf{16}_1$, where the input INB is selected when the mode MODE is set to "1" (recording mode), whereas the input INA is selected when the mode MODE is set to "0" (reproducing mode). A prediction circuit $\mathbf{16}_7$ is comprised of a low-pass filter (LPF) $\mathbf{16}_3$, a predicted signal generator section formed by a variable length delay circuit $\mathbf{16}_4$, an all-pass filter (APF) $\mathbf{16}_5$, and a multiplier $\mathbf{16}_6$, and an adder $\mathbf{16}_2$. The waveform data selected by and delivered from the selector $\mathbf{16}_1$ is supplied to the prediction circuit $\mathbf{16}_7$, where the adder $\mathbf{16}_2$ adds the waveform data to a predicted signal LI generated by the predicted signal generator section to deliver the sum as an synthesized output OUT via an output terminal OUT thereof. In short, the prediction circuit $\mathbf{16}_7$ functions as an expansion circuit (synthesizing filter) in the form of a loop formed by the adder $\mathbf{16}_2$ and the predicted signal generator section.

The coefficient LPFC from the coefficient generator 17 is supplied to the LPF $\mathbf{16}_3$, which controls its own low-pass characteristics, based on the input coefficient LPFC to thereby control the frequency characteristic imparted to waveform data circulated through the loop. The coefficient DT from the coefficient generator 17 is supplied to the delay circuit $\mathbf{16}_4$, which controls the length of its delay period, based on the input coefficient DT to thereby control the length of time required for the waveform data to be circulated through the loop, based on the pitch of a musical tone desired to be reproduced. The coefficient DT is formed by an integer part for designating the length of the delay period in the number of sampling clocks for sampling waveform data used in the PLPC calculating circuit 16, and a decimal part for designating the same length in smaller time intervals than the sampling clocks. The coefficient APFC from the coefficient generator 17 is supplied to the all-pass filter APF $\mathbf{16}_5$, which controls the phase characteristic of each frequency band of the waveform data, based on the input coefficient APFC, while the coefficient G from the coefficient generator 17 is supplied to the multiplier $\mathbf{16}_6$, which controls the attenuating characteristic of the waveform data circulating through the loop, based on the input coefficient G.

The coefficient generator 17 forms the above coefficients per each data item of the residual waveform to be stored into the residual waveform memory in the recording mode (MODE=1), and stores the formed coefficients for delivery thereof according to the tone color TC and the note code (pitch) NCD as required.

Referring again to FIG. 1, the output from the PLPC calculating circuit 16 delivered via the output terminal OUT is applied to one input terminal of a multiplier 18 which has the other input terminal thereof supplied with the output from the envelope generator 13. The multiplier 18 delivers its output to a CH accumulator 19, which accumulates signals allotted to the time slots for time-sharing processing. The results of accumulation of the signals for the time slots are supplied to a digital-to-analog converter 20 for conversion into an analog tone signal, which is supplied to a sound system 21 comprised of loudspeakers, etc. to generate musical tones.

In the present embodiment, as described above, the tone generator is constructed such that it is capable of performing both recording and reproducing of input tone signals by itself. In the recording mode, sampling of an input tone signal is performed by using part of the time-sharing channels of the memory-reading/interpolation circuit 7.

Next, the control operation of the tone generator thus constructed will be described:

In the recording mode, the residual waveform is calculated at the comparison/judgment circuit $\mathbf{4}_2$ by subtracting the predicted signal LI generated based on the coefficients formed by the coefficient generator 17, from the waveform data SINA delivered from the analog-to-digital converter 3 into the buffer memory $\mathbf{4}_1$. The calculated residual waveform is delivered from the analyzing circuit 4 as the output LO to the PLPC calculating circuit 16 as well as to the inverted characteristic filter 6. The comparison/judgment circuit $\mathbf{4}_2$ not only generates the residual waveform but also determines whether or not the coefficients suitable for the waveform data SINA have been formed by the coefficient generator 17, to deliver the results of determination as the signal CC to the coefficient generator 17. The coefficient generator 17 continues to generate the coefficients when the answer to the question (i.e. the results of determination) is affirmative (YES), whereas, if the answer is negative (NO), it varies the values of the coefficients until the answer becomes affirmative (YES).

Since the mode MODE is equal to "1", the PLPC calculating circuit $\mathbf{16}_1$ selects the input INB, and residual waveform data supplied from the analyzing circuit 4 is input to the prediction circuit $\mathbf{16}_7$. The prediction circuit $\mathbf{16}_2$ adds the predicted signal to the residual waveform to generate the synthesized output OUT. The synthesized output OUT is the sum of the original waveform data delivered from the buffer memory $\mathbf{4}_1$ and error components generated during analysis and synthesized thereof. The predicted signal generator section forms the predicted signal from the synthesized output OUT by the use of the coefficients formed by the coefficient generator 17, to deliver same through the output terminal LI to the analyzing circuit 4.

As described previously, the inverted characteristic filter 6 performs filtering of the output LO to impart an inverse frequency characteristic to the residual waveform to cancel the frequency characteristic to be obtained by the interpolation of the memory-reading/interpolation circuit 7. The resulting waveform data is input as a write waveform to the residual waveform memory 5 for storage therein. The residual waveform memory 5 is supplied with a count value from the write counter $\mathbf{4}_3$ as a write address, and the write waveform data from the inverted characteristic filter 6 is written into an address location specified by the count value. In this connection, the write counter $\mathbf{4}_3$ is adapted to change the writing address or area in response to the tone color TC and tone range (or note code (pitch) NCD).

Figure 7A:
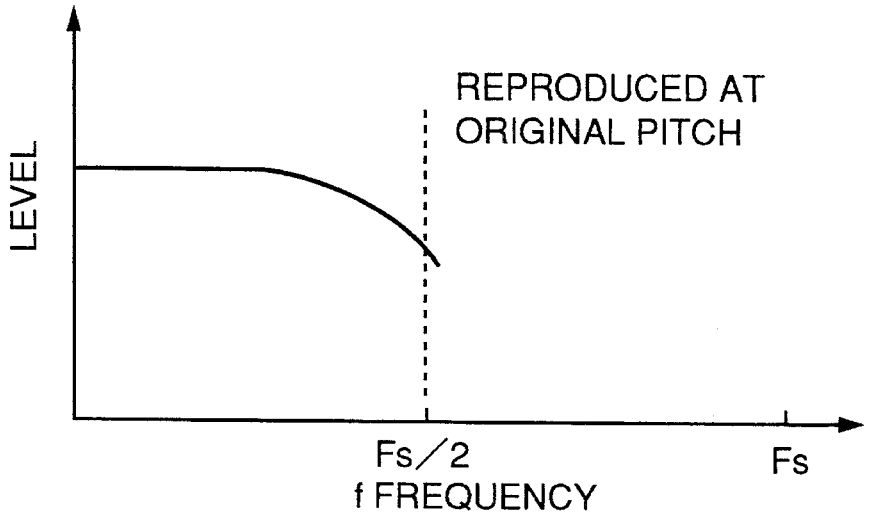
FIG. 7*a* is a diagram showing a frequency characteristic curve of interpolation means exhibited when the pitch of a reproduced tone is identical to that of the original tone sampled in recording.
Figure 7B:
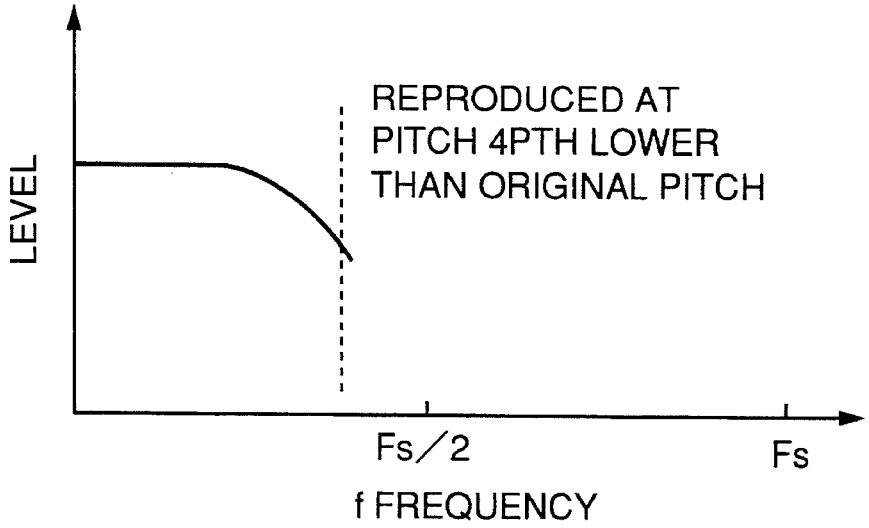
FIG. 7*b* is a diagram showing a frequency characteristic curve of the interpolation means exhibited when the pitch of a reproduced tone is set to a value lower than that of the original tone by P4th.
Figure 7C:
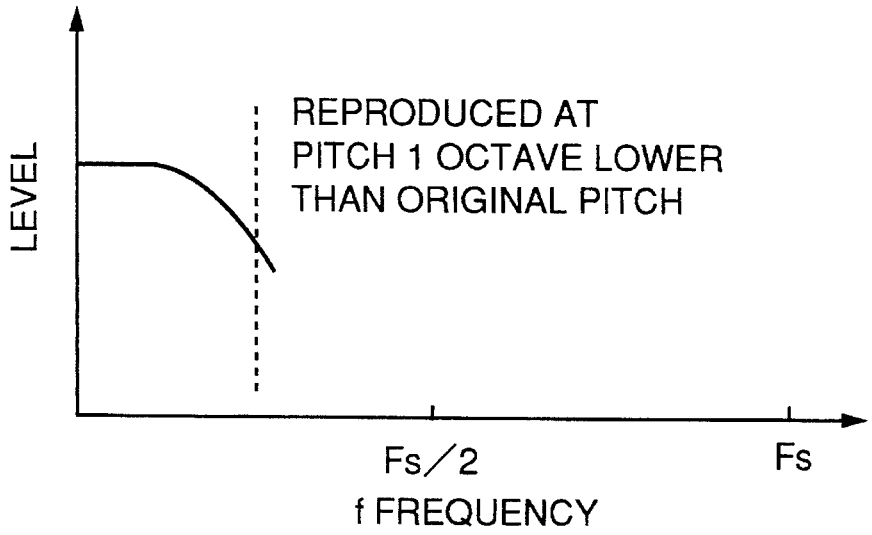
FIG. 7C is a diagram showing a frequency characteristic curve of the interpolation means exhibited when the pitch of a reproduced tone is set to a value lower than that of the original tone by one octave.

Next, the control operation in the reproducing mode (MODE=0) will be described. Depression of a key of the keyboard 8 designates a note code NCD to cause generation of a note-on signal. The memory-reading/interpolation circuit 7 selects and reads data of a residual waveform stored at an address corresponding to the designated node code NCD and tone color TC then selected. The reading rate corresponds to the note code NCD, as described hereinbefore with reference to FIG. 5. To modify the data read out into data suitable for processing at the fixed sampling frequency, in the present embodiment, interpolated waveform samples are prepared by eight-point interpolation from waveform sample data read out from the residual waveform memory 5. As described hereinabove, the frequency characteristics of interpolation are illustrated in FIG. 7. To cancel the frequency characteristics, the inverted characteristic filter 6 is provided.

Thus, the interpolated waveform samples prepared from the waveform sample sampled data read out from the residual waveform memory 5 and subjected to interpolation are supplied as the input INA to the PLPC calculating circuit 16. Since the mode MODE is equal to "0", the selector $\mathbf{16}_1$ selects the input INA, and then interpolated waveform samples from the memory-reading/interpolation circuit 7 are supplied to the prediction circuit $\mathbf{16}_7$.

On this occasion, coefficients are supplied to the prediction circuit $\mathbf{16}_7$ from the coefficient generator 17, which are prepared with reference to the coefficients LPFC, DT, APFC, and G used to write the residual waveform into the memory 5 in recording, which has now been read out therefrom according to the tone color TC and the note code NCD, such that part or all of the coefficients are made delicately or slightly (or otherwise largely) different from the reference coefficients used in recording. The coefficient generator 17 is provided with coefficient control operating elements, not shown, for adjusting the values of the coefficients as desired by the operator of the instrument. In this connection, a plurality of sets of coefficients after adjustment may be stored for each of the residual waveforms to permit designation of a residual waveform and a set of coefficients suitable therefor. This enables a plurality of tone colors to be generated from one residual waveform.

The prediction circuit $\mathbf{16}_7$ adds, at the adder $\mathbf{16}_2$, the predicted signal generated by the predicted signal generator section to the interpolated residual waveform data to form the synthesized output OUT. At this time, the predicted signal generator section forms the synthesized output OUT by the use of the above-mentioned coefficients. The sampling frequency of the prediction circuit $\mathbf{16}_7$ is identical to that of the memory-reading/interpolation circuit 7, and hence the interpolated waveform samples, the predicted signal, and the synthesized output OUT are all in the form of waveform data sampled at the same sampling frequency.

The memory-reading/interpolation circuit 7 reads out data from the residual waveform memory 5 at a reading rate (a speed at which the reading address number increases) which is determined with reference to a rate proportional to the difference between a pitch corresponding to the original waveform SIN of the residual waveform used for tone generation and a pitch corresponding to the note code NCD specified by the depressed key. On the other hand, the coefficient generator 17 generates coefficients which are corrected with reference to coefficients as reference values used by the PLPC calculating circuit 16 in recording of the original waveform, by scaling processing according to the pitch difference. As the "reference values", the values of the coefficients used in the recording may be directly used, if the pitch of the original waveform recorded coincides with the note code NCD. The recording/reproducing system of the tone generator of the present invention aims at reproducing, based on the original waveform, waveforms different in tone color from the original waveform. To this end, the tone generator can form coefficients for use in the reproducing mode, part or all of which have values slightly or largely different from the coefficients used in the recording mode, with reference to the latter.

The output (reproducing waveform) from the PLPC calculating circuit 16 is multiplied by the multiplier 18 by an envelope generated by the envelope generator 13 based on the note code NCD and the tone color TC, and then the resulting product is accumulated by the channel accumulator 19 for all the channels, followed by conversion into an analog signal by the digital-to-analog converter 20 and then into a musical tone by the sound system 21.

Thus, the memory-reading/interpolation circuit 7, the PLPC calculating circuit 6, the envelope generator 13, the multiplier 18, etc. operate in time-sharing channel manner, permitting one common circuit to generate a plurality of musical tones at the same time. The residual waveform data read out in the pitch-asynchronous manner and interpolated thereafter is supplied to the prediction circuit $\mathbf{16}_7$, to thereby cause the PLPC calculating circuit 16 as well to operate in the pitch-asynchronous manner. This enables the tone generator to operate in time-sharing channel manner.

As described heretofore, the tone generator of the present embodiment converts the tone signal input by the microphone 1 into a residual waveform by the converting method called PLPC, similarly to an ordinary tone generator, and then stores the residual waveform into the residual waveform memory 5. When the player desires to reproduce the tone signal, the waveform data stored in the residual waveform memory 5 is read out and converted in a manner inverse to that in storing the waveform, to deliver the resulting signal to the sound system 21 for reproduction of the musical tone. The sampling frequency used in recording and that used in reproducing are set to a fixed value. When a tone signal is to be reproduced which is different in pitch from the input tone signal, particularly by the use of waveform data other than waveform data stored in the residual waveform memory 5, the waveform for reproducing a musical tone is synthesized by interpolating waveform data read from the residual waveform memory 5. Therefore, even if the frequency characteristic of the memory-reading/interpolation circuit 7, which performs interpolation by the use of the interpolating coefficient memory $\mathbf{7}_6$, is not flat, data for storage into the residual waveform memory 5 is prepared by compressing an input tone signal after imparting thereto a frequency characteristic inverse to the frequency characteristic exhibited in interpolation. As a result, the reproduced tone signal has a flat frequency characteristic.

Although in the present embodiment, eight-point interpolation is performed by the use of FIR filter coefficients, the point number is not limited to eight, and the kind of the filter is not limited to the FIR filter, either. For example, a linear interpolating filter or any other suitable LPF filter may be used.

Further, the inverted characteristic filter 6 is not limited to a FIR filter. Any other type filter may be used insofar as it has a frequency characteristic which is inverse to a frequency characteristic of the interpolating filter exhibited within an effective frequency range thereof. For example, it may be replaced by an IIR filter.

Although in the present embodiment, the mode MODE is statically set by operating the mode switch, this is not limitative, but the mode may be dynamically set, for instance, such that it is set to the recording mode (MODE=1) only at a particular time-sharing channel CH within one sampling period, and set to the reproducing mode (MODE=0) at the other time-sharing channels. By thus setting the mode MODE, a waveform input from the microphone 1 can be subjected to analysis and then stored into the residual waveform memory, while at the same time musical tones can be generated by reading waveforms from the residual waveform memory and subjecting same to synthesization. In such a variation, the PLPC calculating circuit 16 performs, on time-sharing basis, the prediction operation to obtain a residual waveform by analysis of the input waveform, and the prediction operation to calculate a synthesized waveform from the residual waveform. This can be quite easily realized by the use of time slots which are inherently provided in a number corresponding to the number of the tone-generating channels for time-sharing operation.

What is claimed is:

1. A tone generating apparatus which generates a musical tone based on an original waveform signal obtained by sampling in accordance with a predetermined sampling clock, comprising:

loop means for circulating an input signal therein to generate a waveform signal having a predetermined characteristic;

analyzing means, having an inverse characteristic to said predetermined characteristic of said waveform signal generated by said loop means, for receiving said original waveform signal and for analyzing said original waveform signal in accordance with said inverse characteristic, said analyzing means producing an output indicative of results of said analysis;

memory means for storing said results of said analysis by said analyzing means;

readout means for reading out said results of said analysis from said memory means;

interpolating means for interpolating said results of said analysis read out from said memory means, said interpolating means generating results of said interpolation in synchronism with said sampling clock to supply the results of said interpolation to said loop means as said input signal; and correcting means for correcting said results of said analysis by said analyzing means so as to cancel a frequency characteristic to be imparted to said results of said analysis when said results of said analysis are interpolated by said interpolating means;

said results of said analysis being stored into said memory means after having been corrected by said correcting means.

2. A tone generating apparatus according to claim 1, including pitch-designating means for designating a pitch of a musical tone to be reproduced, and wherein said readout means includes numerical value generating means for generating a reading numerical value which is variable at a rate proportional to said pitch of said musical tone designated by said pitch-designating means, in synchronism with predetermined clock timing, said readout means reading said results of said analysis from said memory means in accordance with said reading numerical value.

3. A tone generating apparatus according to claim 1, wherein said correcting means adjusts a level of predetermined frequency components of a waveform signal representative of said results of said analysis.

4. A tone generating apparatus according to claim 2, wherein said correcting means adjusts a level of predetermined frequency components of a waveform signal representative of said results of said analysis.

5. A tone generating apparatus which generates a musical tone based on an input waveform signal, said apparatus comprising:

synthesizing filter means for generating synthesized signals having a predetermined characteristic;

analyzing means for analyzing said input waveform signal in accordance with an inverse characteristic to said predetermined characteristic of said synthesized signals, said analyzing means receiving said input waveform signal and said synthesized signals from said synthesizing filter means and producing an output indicative of results of said analysis;

waveform memory means for storing waveform signals analyzed by said analyzing means;

pitch-designating means for designating a pitch of a musical tone to be generated;

delay means for delaying said synthesized signals by an amount corresponding to said designated pitch;

reading numerical value-generating means for generating a reading numerical value formed of an integer part and a decimal part in synchronism with a predetermined clock timing, said reading numerical value being variable at a rate proportional to said pitch of said musical tone designated by said pitch designating means;

reading means for reading said analyzed waveform signals from said waveform memory means based on said integer part of said reading numerical value;

interpolating means for generating interpolated signals, based on said waveform signals read out from said waveform memory in accordance with said decimal part of said reading numerical value, in synchronism with said predetermined clock timing; and wherein said synthesizing filter means generates synthesized signals based on said delayed synthesized signals and said interpolated signals.

6. A tone generating apparatus, comprising:

waveform input means for inputting an original waveform signal;

analyzing filter means for analyzing said original waveform signal input by said waveform input means and for generating a waveform signal representative of results of said analysis;

converting means for converting said waveform signal representative of said results of said analysis by changing a sampling interval for reading said waveform signal representative of said results of said analysis to deliver a converted waveform signal, said converting means imparting a predetermined frequency characteristic to said waveform signal representative of said results of said analysis when said sampling interval is changed;

correcting means, interposed between said analyzing filter means and said converting means, for correcting said waveform signal representative of said results of said analysis such that said predetermined frequency characteristic is canceled; and synthesizing filter means for synthesizing a musical tone signal indicative of a musical tone, based on said converted waveform signal.

7. A tone generating apparatus according to claim 6, including memory means for storing data of said waveform signal representative of said results of said analysis, and wherein said converting means includes:

pitch-designating means for designating a pitch of said musical tone;

reading numerical value-generating means for generating a reading numerical value formed of an integer part and a decimal part, in synchronism with a predetermined timing clock, said reading numerical value being variable at a rate proportional to said pitch of said musical tone designated by said pitch—designating means;

reading means for reading said data of said waveform representative of said results of said analysis from said memory means, based on said integer part of said reading numerical value; and interpolating means for generating interpolated signals, based on said data of said waveform signal representative of said results of said analysis read from said memory means, by the use of said decimal part of said reading numerical value, in synchronism with said predetermined timing clock.

8. A tone generating apparatus according to claim 7, wherein said converting means imparts a predetermined frequency characteristic to said waveform signal representative of said results of said analysis, when said sampling interval is changed, said tone generating apparatus including correcting means interposed between said analyzing filter means and said converting means, for correcting said waveform signal representative of said results of said analysis such that said predetermined frequency characteristic is canceled.

9. A tone generating apparatus according to claim 6, wherein said correcting means raises a level of higher frequency components of said waveform signal representative of said results of said analysis.

10. A tone generating apparatus which generates a tone signal based on waveform data, comprising:

a waveform memory for storing said waveform data;

waveform input means for inputting an original waveform signal;

analyzing filter means for analyzing said original waveform signal input by said waveform input means, and for generating a waveform signal representative of results of said analysis;

correcting means for correcting said waveform signal from said analyzing filter means by adjusting a level of higher frequency components thereof, and for delivering the corrected waveform signal; and writing means for writing the corrected waveform signal into said waveform memory.

* * * * *